US006186274B1

(12) United States Patent
Reynolds et al.

(10) Patent No.: US 6,186,274 B1
(45) Date of Patent: Feb. 13, 2001

(54) SAFETY SYSTEM

(75) Inventors: Charles Gregory Reynolds, Franklin; William G. Kiniry, Duxbury, both of MA (US)

(73) Assignee: Bay Nets, Inc., Braintree, MA (US)

( * ) Notice: Under 35 U.S.C. 154(b), the term of this patent shall be extended for 0 days.

(21) Appl. No.: 09/563,592

(22) Filed: May 3, 2000

Related U.S. Application Data

(63) Continuation-in-part of application No. 08/977,069, filed on Nov. 24, 1997, now Pat. No. 6,098,750.
(60) Provisional application No. 60/031,710, filed on Nov. 25, 1996.

(51) Int. Cl.[7] ..... A62B 1/22
(52) U.S. Cl. ..... 182/138; 182/112
(58) Field of Search ..... 182/138, 113, 182/137, 112

(56) References Cited

U.S. PATENT DOCUMENTS

| | | | |
|---|---|---|---|
| 1,244,670 | 10/1917 | Whitney | 182/113 |
| 2,895,716 | 7/1959 | Veltri | 256/23 |
| 3,527,319 | 9/1970 | Pedley | 182/139 |
| 3,752,262 | 8/1973 | Helms | 182/113 |
| 3,797,827 | 3/1974 | Child | 273/35 R |
| 4,083,535 | 4/1978 | Britt | 256/24 |
| 4,129,197 | 12/1978 | Preston | 182/82 |
| 4,401,186 | 8/1983 | Dobersch | 182/113 |
| 4,730,810 | 3/1988 | Rambaud | 256/12.5 |
| 4,738,335 | 4/1988 | Ishii | 182/129 |
| 4,787,602 | 11/1988 | Pidgeon | 256/23 |
| 4,852,194 | 8/1989 | Langan | 5/427 |
| 4,856,615 | 8/1989 | Nusbaum | 182/82 |
| 4,875,549 | 10/1989 | Denny et al. | 182/138 |
| 4,979,589 | 12/1990 | Sugiyama et al. | 182/38 |
| 4,979,701 | 12/1990 | Colarik et al. | 244/110 C |
| 4,986,389 | 1/1991 | Halligan, Sr. et al. | 182/138 |
| 5,161,641 | 11/1992 | Nusbaum | 182/138 |
| 5,182,889 | 2/1993 | Johnson | 52/298 |
| 5,221,076 | 6/1993 | Zust | 256/31 |
| 5,299,654 | 4/1994 | Duncan | 182/138 |
| 5,402,988 | 4/1995 | Eisele | 256/24 |

*Primary Examiner*—Alvin Chin-Shue
(74) *Attorney, Agent, or Firm*—Weingarten, Schurgin, Gagnebin & Hayes LLP

(57) ABSTRACT

A motorized safety system which protects the open side of a mezzanine, loading dock or other elevated work area when in use. The safety system is easy to use while requiring only minimal floor space. The safety system comprises two posts, each post having a motor mounted on the top of the post, a control unit for controlling and sychronizing motor operation mounted on the side of one post, a movable arm having a safety net and associated hardware such that when the safety system is in a first position the opening of the mezzanine or loading dock is substantially covered by the net. When the safety system is in a second position, the arm and net are out of the way, allowing access by workers and machinery to and from the open side. The operation of the safety system from the first position to the second position or vice versa is performed remotely using a wireless hand held device that transmits instructions to the control unit, thus further reducing the risk of falling.

6 Claims, 12 Drawing Sheets

SAFETY SYSTEM

CROSS REFERENCE TO RELATED APPLICATIONS

This application is a continuation in part under 37 C.F.R. § 153(b) of patent application Ser. No. 08/977,069, filed Nov. 24, 1997, U.S. Pat. No. 6,098,750, issued Aug. 8, 2000, which claims priority under 35 U.S.C. § 119(e) to provisional patent application serial No. 60/031,710, filed Nov. 25, 1996.

STATEMENT REGARDING FEDERALLY SPONSORED RESEARCH OR DEVELOPMENT

Not Applicable

BACKGROUND OF THE INVENTION

A warehouse or similar style building typically includes an open-sided mezzanine level which is used for storing pallets of material, as well as a loading dock which is open to the outside at a predetermined height so that trucks, once backed up to the dock, can be easily unloaded. The open sides of the mezzanine and the loading dock pose serious safety risks. A misplaced step by a worker can send the worker over the edge of the mezzanine or loading dock, posing danger to the worker as well as any workers below. A misplaced carton or pallet can also tumble off the mezzanine or loading dock and possibly injure people or materials located below. Injuries resulting from workers or material falling off of open mezzanines and loading docks are one of OSHA's top ten most frequently violated standards.

Previous attempts to reduce the risk of open-sided mezzanines and loading docks have proven relatively unsuccessful. Yellow warning lines painted on the floor have achieved limited results at best. Steel fencing systems have proven effective when closed, but require a great deal of floor space since they typically are swung into and out of position. Further, operating a steel fence system places a worker at the edge of the mezzanine or loading dock, creating a safety hazard of its own. The opening and closing of steel systems require substantial time by one or more employees and as such are costly to use as well as to purchase. Workers tend to avoid using safety systems which interrupt work flow, and when a safety system is not used, it can not afford protection.

BRIEF SUMMARY OF THE INVENTION

A motorized safety system is disclosed which protects the open side of a mezzanine, loading dock or other elevated work area when in use. The safety system is easy to use while requiring only minimal floor space. The safety system comprises two posts, each post having a motor mounted on the top of the post, a control unit for controlling and sychronizing motor operation mounted on the side of one post, a movable arm having a safety net and associated hardware such that when the safety system is in a first position the opening of the mezzanine or loading dock is substantially covered by the net. When the safety system is in a second position, the arm and net are out of the way, allowing access by workers and machinery to and from the open side. The operation of the safety system from the first position to the second position or vice versa is performed using a wireless hand held device that transmits instructions to the control unit, thus further reducing the risk of falling.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
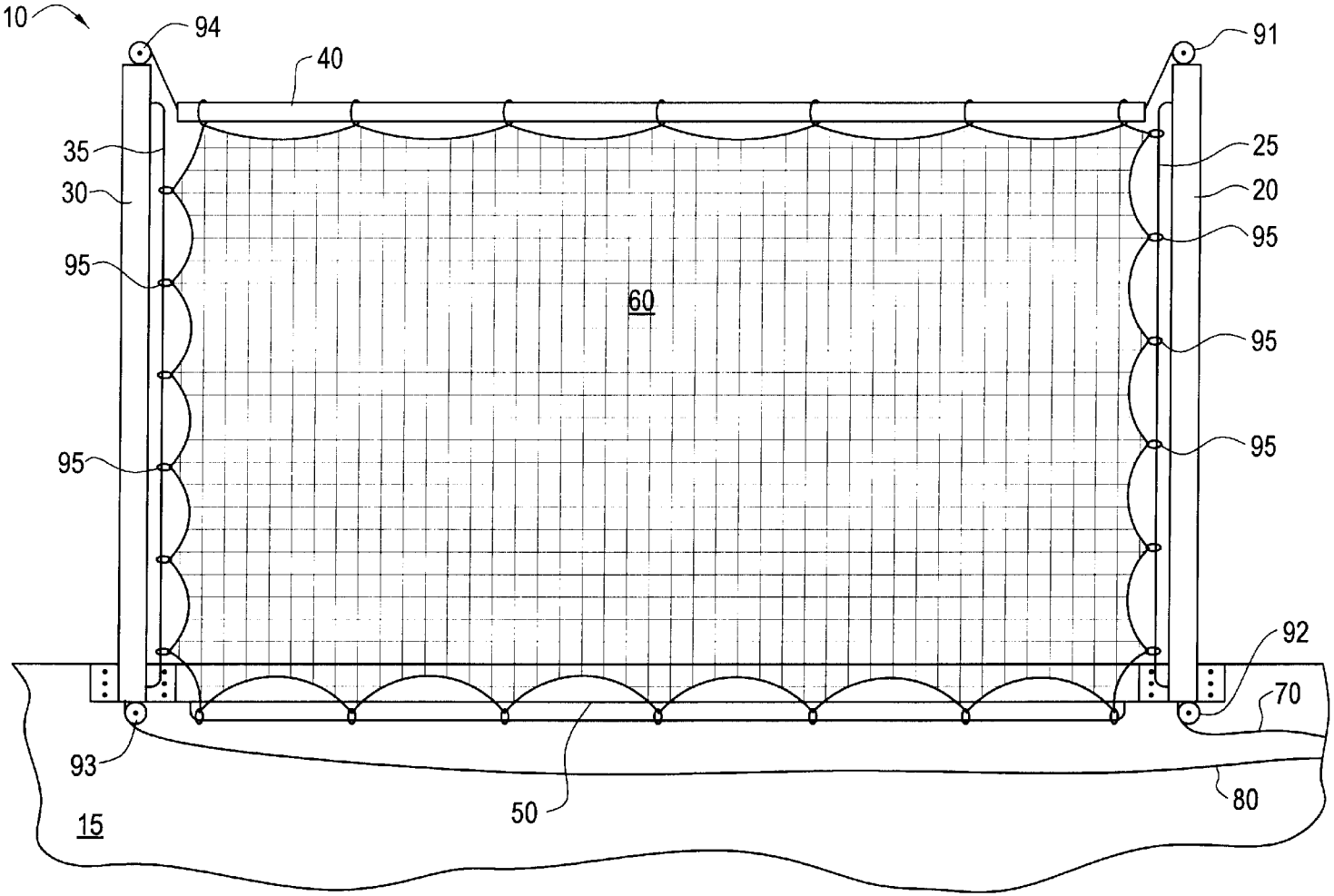
FIG. 1 is a front view of a first embodiment of the safety system in the closed position.

Referring to FIG. 1, a first embodiment of a safety system 10 for use with a mezzanine opening or other elevated work area is shown. In warehouses, mezzanine shelving is typically used to hold inventory. The inventory is typically placed on the shelving with a fork lift. Often, employees must also work on these upper levels to maneuver the inventory. A fall hazard arises when employees work in the area between the inventory and the edge of the shelving. Employers are required to protect their employees from such a fall hazard. However, it is difficult to put up a barrier to keep people from falling because it interferes with the operation of the fork lift.

The system 10 in this embodiment comprises two generally vertical posts 20 and 30, a generally horizontal top arm 40, a bottom assembly 50, a safety net 60, a cable system and associated hardware. The posts 20 and 30 are permanently secured to a structure 15 such as the mezzanine floor and may include a guide rod 25 and 35 for moveable securement of the safety net 60. The safety net 60 is suspended between the posts 20 and 30, the top arm 40 and the bottom assembly 50 by spring snap links 95 or the like. A first rope or cable 70 is strung from the ground level, over first pulley 92 disposed at the bottom of post 20, through the post 20, over a second pulley 91 disposed at the top of the post and attached to one end of the top arm 40. A second rope or cable 80 is strung from the ground level, over third pulley 93 disposed at the bottom of post 30, through the post 30, over a fourth pulley 94 disposed at the top of the post 30 and attached to a second end of the top arm 40. Additional pulleys may also be utilized to further guide the cables.

The bottom assembly is secured between the bottom of the posts 20 and 30. The bottom assembly can be an arm, a plurality of anchors fixed to the structure, or a cable extending between the posts 20 and 30.

The first cable 70 and second cable 80 allow for movement of the top arm from a first position wherein the top arm is disposed between the top of the posts, and a second position wherein the top arm is disposed between the bottom of the posts 20 and 30.

When the top arm is disposed at it's first position, the safety net 60 substantially covers an opening defined by the posts 20 and 30, the bottom assembly 50, and the top arm 40. In such a position the risk that a worker or material will fall off the mezzanine shelf is greatly reduced.

Figure 2:
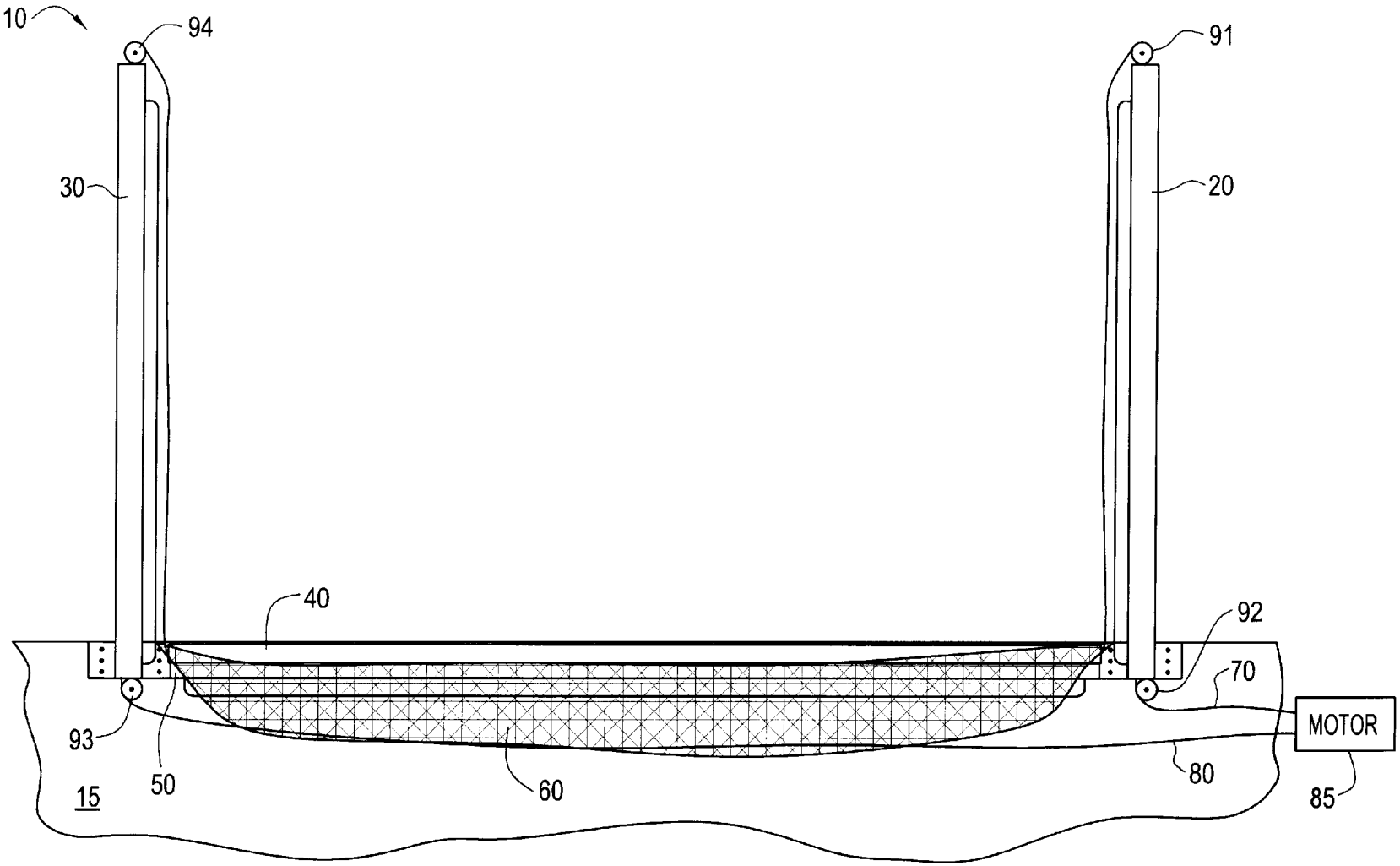
FIG. 2 is a front view of the safety system of FIG. 1 shown in the open position.

When the cables 70 and 80 are extended, the weight of the top arm 40 causes the system to retract, with the top arm and safety net falling below the top surface of the mezzanine shelf as shown in FIG. 2. In this second position the safety net 60 is out of the way, and allows access between the posts 20 and 30 by people or machinery. The cables 70 and 80 allow for the movement of the top arm from the first position to the second position. The cables are secured such as by being tied to "c cleats", fixed in position by operation of cable locks, or by some other securing device. A motor 85 may be used to provide for extension and retraction of the cables. The cables allow for operation of the safety system between its first and second positions remotely from the opening, thereby removing a safety risk to the operator.

Figure 3:
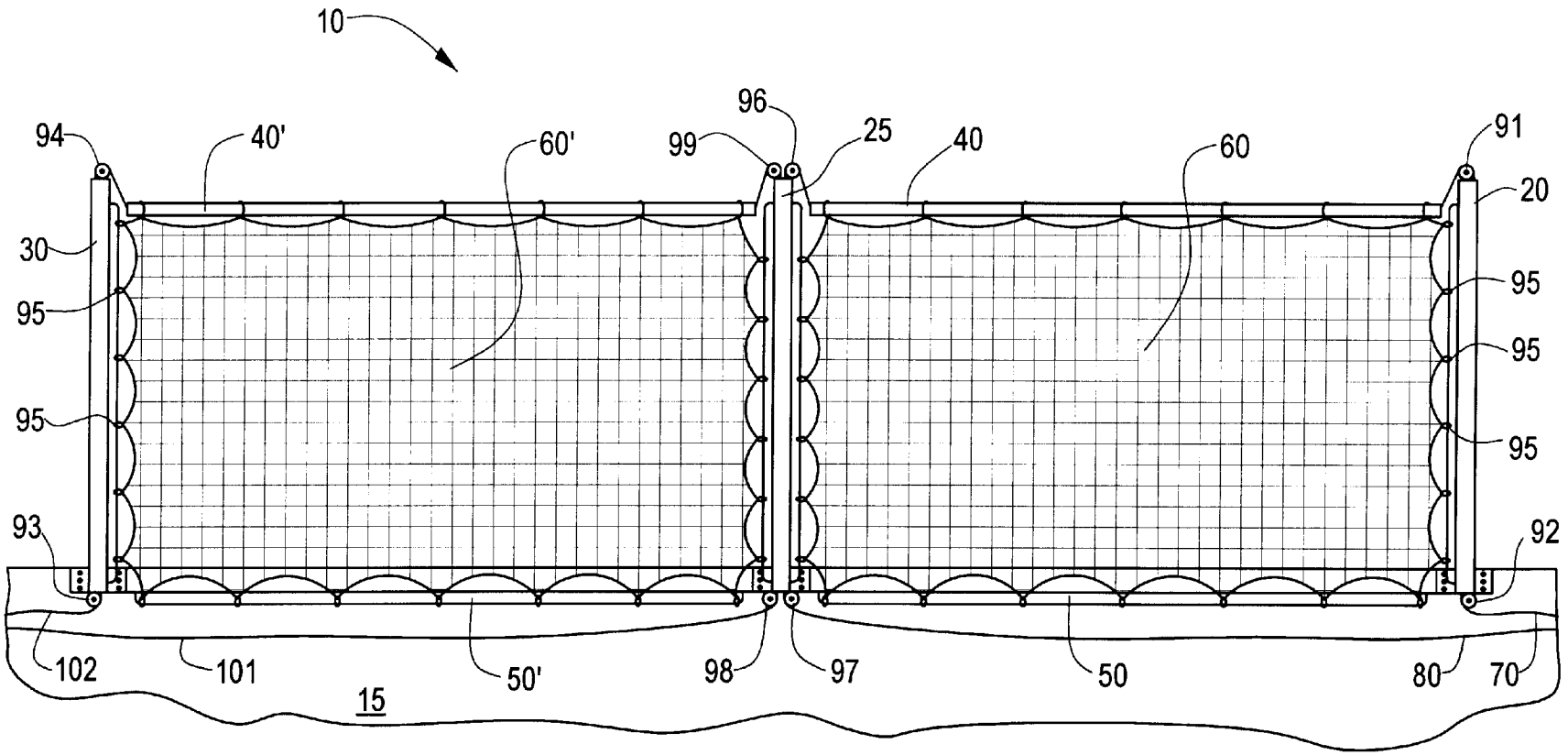
FIG. 3 is a front view of an embodiment of a safety system including multiple posts.
Figure 4:
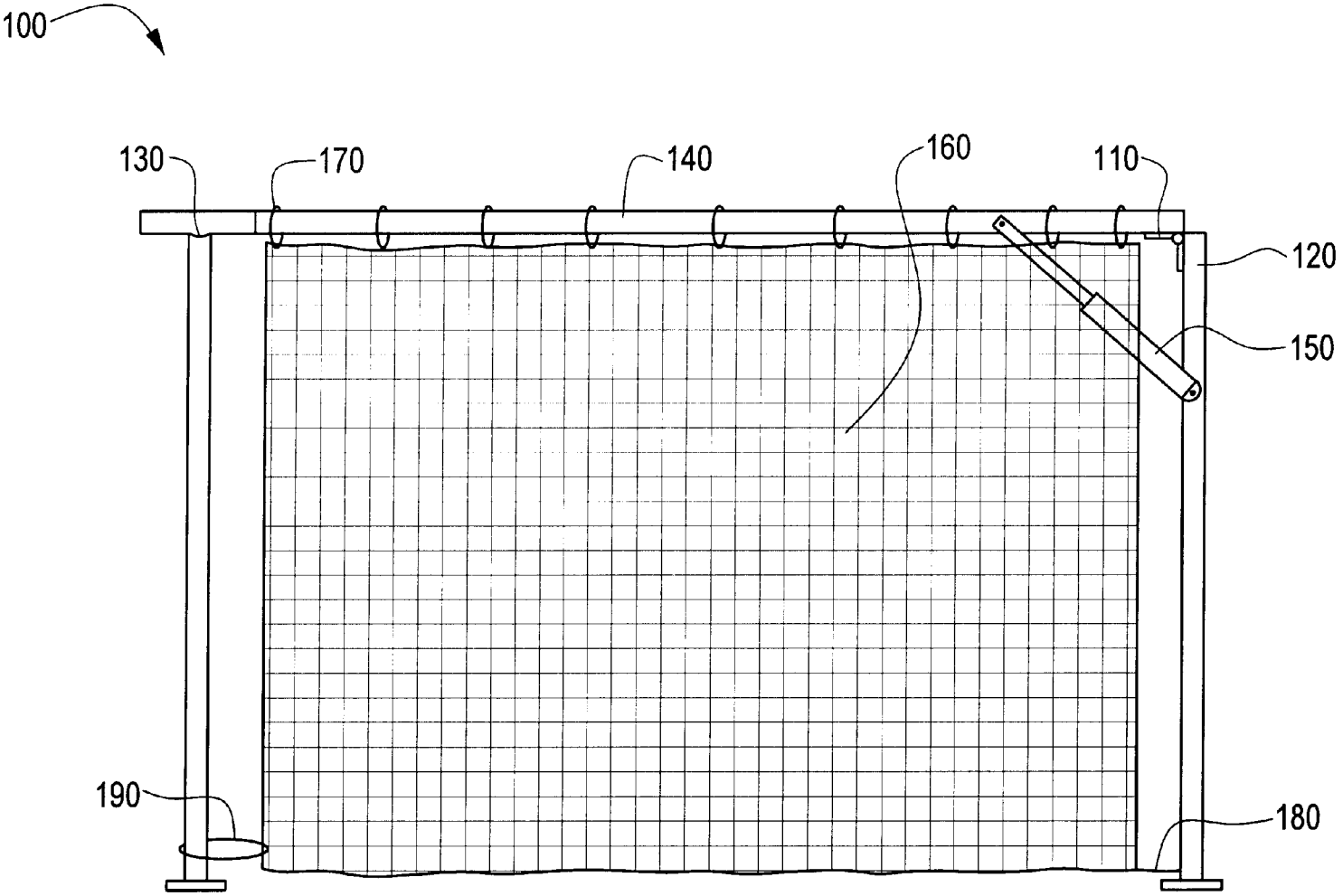
FIG. 4 is a front view of a second embodiment of the safety system in the closed position.
Figure 5:
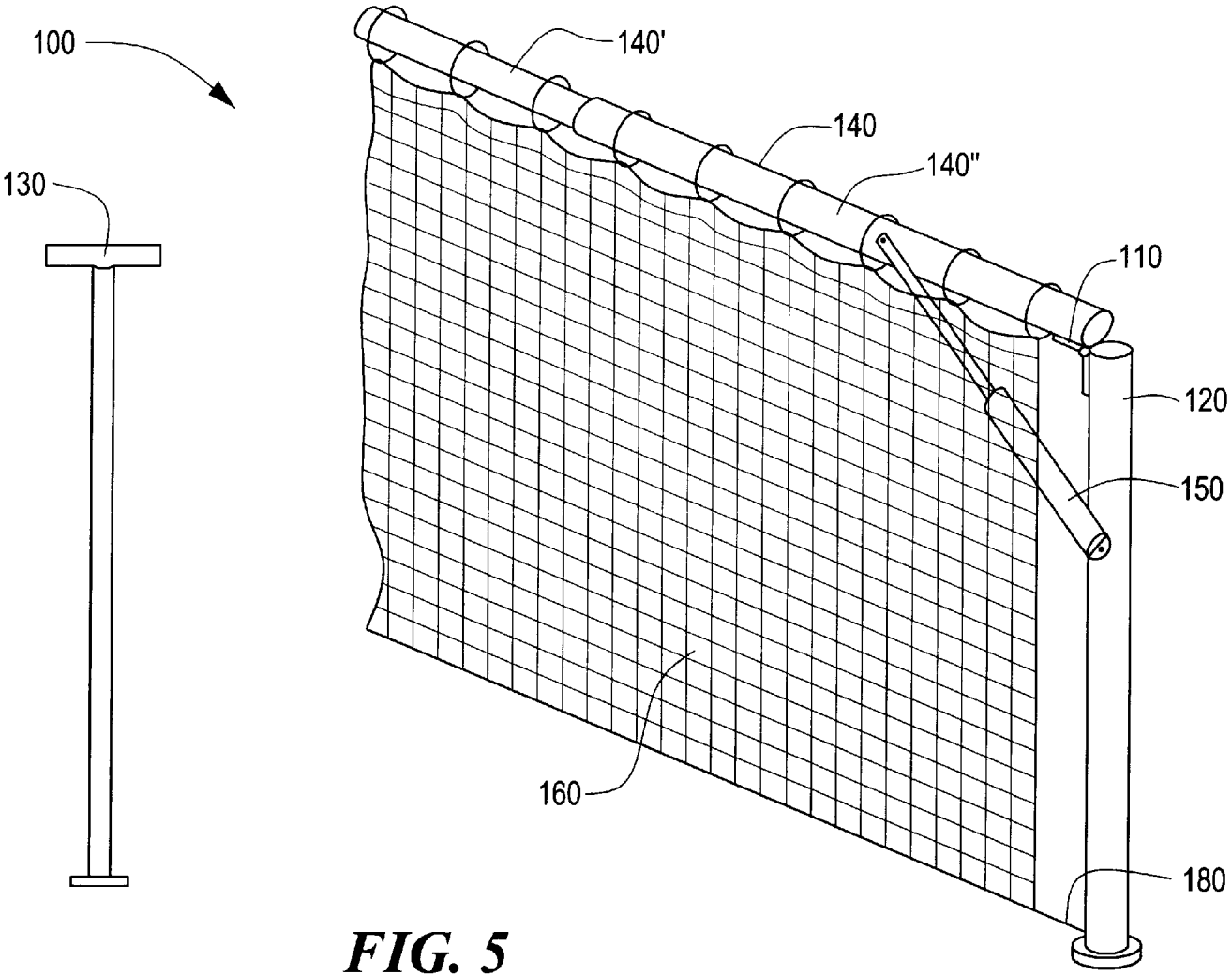
FIG. 5 is a front view of the safety system of FIG. 4 in a partially open position.
Figure 6:
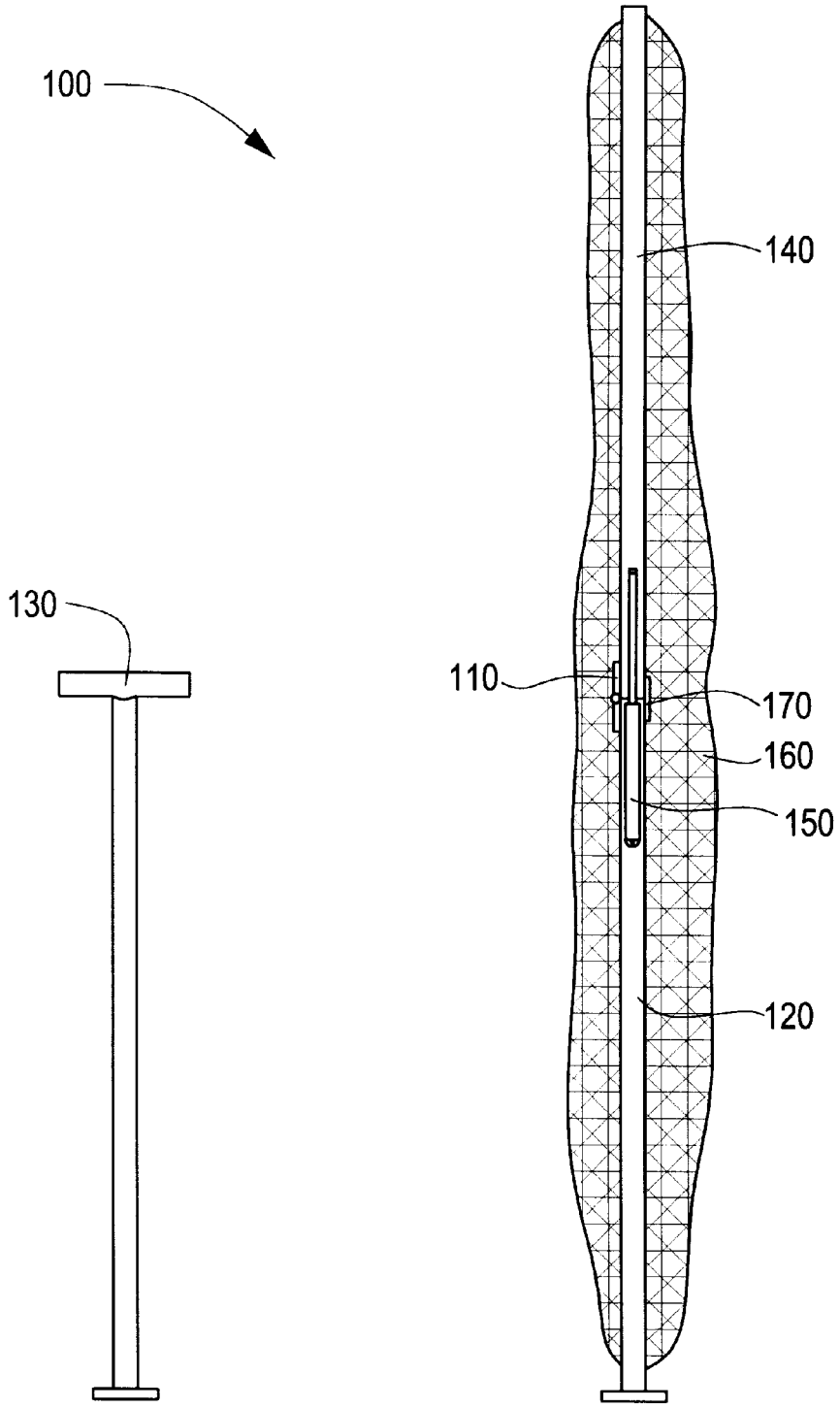
FIG. 6 is a front view of the safety system of FIG. 4 in the open position.

Referring now to FIG. 3, a series of safety systems 10 are shown installed along an upper level. While only two systems are shown, it should be realized that any number of systems could be connected together using a plurality of safety nets, center posts, a left post, a right post and associated hardware.

The system in this embodiment comprises two generally vertical posts 20 and 30, a center post 25, a pair of generally horizontal top arms 40 and 40', a pair of bottom assemblies 50 and 50', a pair of safety nets 60 and 60', and associated hardware. The posts 20 and 30 are permanently secured to a structure 15 such as the mezzanine floor as is center post 25. Safety net 60 is suspended between the posts 20 and 25, the top arm 40 and the bottom assembly 50 by spring snap links 95 or the like. Safety net 60' is suspended between the posts 30 and 25, the top arm 40' and the bottom assembly 50' by spring snap links 95 or the like.

A first rope or cable 70 is strung from the ground level, over first pulley 92, through the post 20, over a second pulley 91 disposed at the top of the post 20 and attached to a first end of the top arm 40. A second rope or cable 80 is strung from the ground level, over a third pulley 97 disposed at the bottom of the center post 25, through the center post 25, over a fourth pulley 96 disposed at the top of the post 25 and attached to a second end of the top arm 40. A third cable 101 is strung from the ground level, over a fifth pulley disposed at the bottom of the center post 25, through the center post 25, over a sixth pulley 99 disposed at the top of the center post 25 and attached to a first end of the top arm 40'. A fourth cable 102 is strung from the ground level, over seventh pulley 93 disposed at the bottom of post 30, through the post 30, over an eighth pulley 94 disposed at the top of the post 30 and attached to a second end of the top arm 40'.

The bottom assembly 50 is disposed between the bottom of the posts 20 and 25. The bottom assembly 50' is disposed between the bottom of posts 25 and 30. The bottom assemblies can be an arm, a plurality of anchors fixed to the structure, or a cable extending between the posts 20 and 25, and between the posts 25 and 30.

The first cable 70 and second cable 80 allow for movement of the top arm 40 from a first position wherein the top arm is disposed between the top of the posts 20 and 25, and a second position wherein the top arm 40 is disposed between the bottom of the posts 20 and 25. The third cable 101 and fourth cable 102 allow for movement of the top arm 40' from a first position wherein the top arm 40' is disposed between the top of the posts 25 and 30, and a second position wherein the top arm 40' is disposed between the bottom of the posts 25 and 30.

When the top arms are disposed at their first position, the safety net 60 substantially covers an opening defined by the posts 20 and 25, the bottom assembly 50, and the top arm 40. Also in such a position the safety net 60' substantially covers an opening defined by the posts 25 and 30, the bottom assembly 50' and the top arm 40'. In such a position the risk that a worker or material will fall off the mezzanine shelf is greatly reduced.

When the cables 70 and 80 are extended, the weight of the top arm 40 causes the system to retract, with the top arm 40 and safety net 60 falling below the top surface of the mezzanine shelf. In this second position the safety net 60 is out of the way, and allows access between the posts 20, 30 by people or machinery. Similarly, when the cables 101 and 102 are extended, the weight of the top arm 40' causes the system to retract, with the top arm 40' and safety net 60' falling below the top surface of the mezzanine shelf. In this second position the safety net 60' is out of the way, and allows access between the posts 20 and 25 or 25 and 30 by people or machinery. The operation of moving the system between the first and second positions can occur independently. For example, thus safety net 60 could be in the first position while safety net 60' is in the second position.

Referring now to FIGS. 4–7 a further embodiment 100, in this instance for a loading dock or other elevated work area, is shown. The loading dock safety system 100 is used to keep people from falling off of elevated loading docks when the bay door is open and there is no truck covering the opening. The system 100 is readily employed and deployed, multiple times per day. The system 100 is out of the way of the business activities at the facility when not in use.

In this embodiment the safety system 100 comprises a lower arm or post 120 secured to a floor or other structure just inside one side of the elevated loading dock door. Attached to this lower post 120 is a hinged upper arm or post 140. The upper arm 140 may be telescopic such that a first section 140' of the upper arm is receivable within a second section 140" of the upper arm. The safety net 160 is secured to the upper arm with circular links. The upper arm is movable between a first position and a second position.

In the first position, the upper arm 140 is generally horizontal and is extended across the entire opening of the bay door (not shown) and attached to another post or reception arm 130 permanently mounted to the floor just inside the other side of the elevated loading dock door. A portion of the safety net 160 is permanently attached at the top to the outer most point of the arm so that the net 160 slides open and closed with the arm and does not bunch up when the arm is raised. Furthermore, the bottom corner, closest to the hinged post is permanently affixed to the hinged post by link 180. The opposite bottom corner is removably attached to the receiving post, via a spring snap link 190, each time the arm is engaged and disengaged. In the first position the safety net substantially covers the loading dock opening, and greatly reduces the risk of a worker or material falling off the loading dock.

In the second position, the arm is raised upright so as to be out of the way of the door (similar to a rail road crossing gate). The upper arm 140 can be locked in this position by lock 170. When the safety system 100 is to be engaged, the arm is unlocked from its first upright position and lowered to its second generally horizontal position. A pressurized shock 150 may be included to assist in the lifting and lowering of the upper arm.

Figure 7:
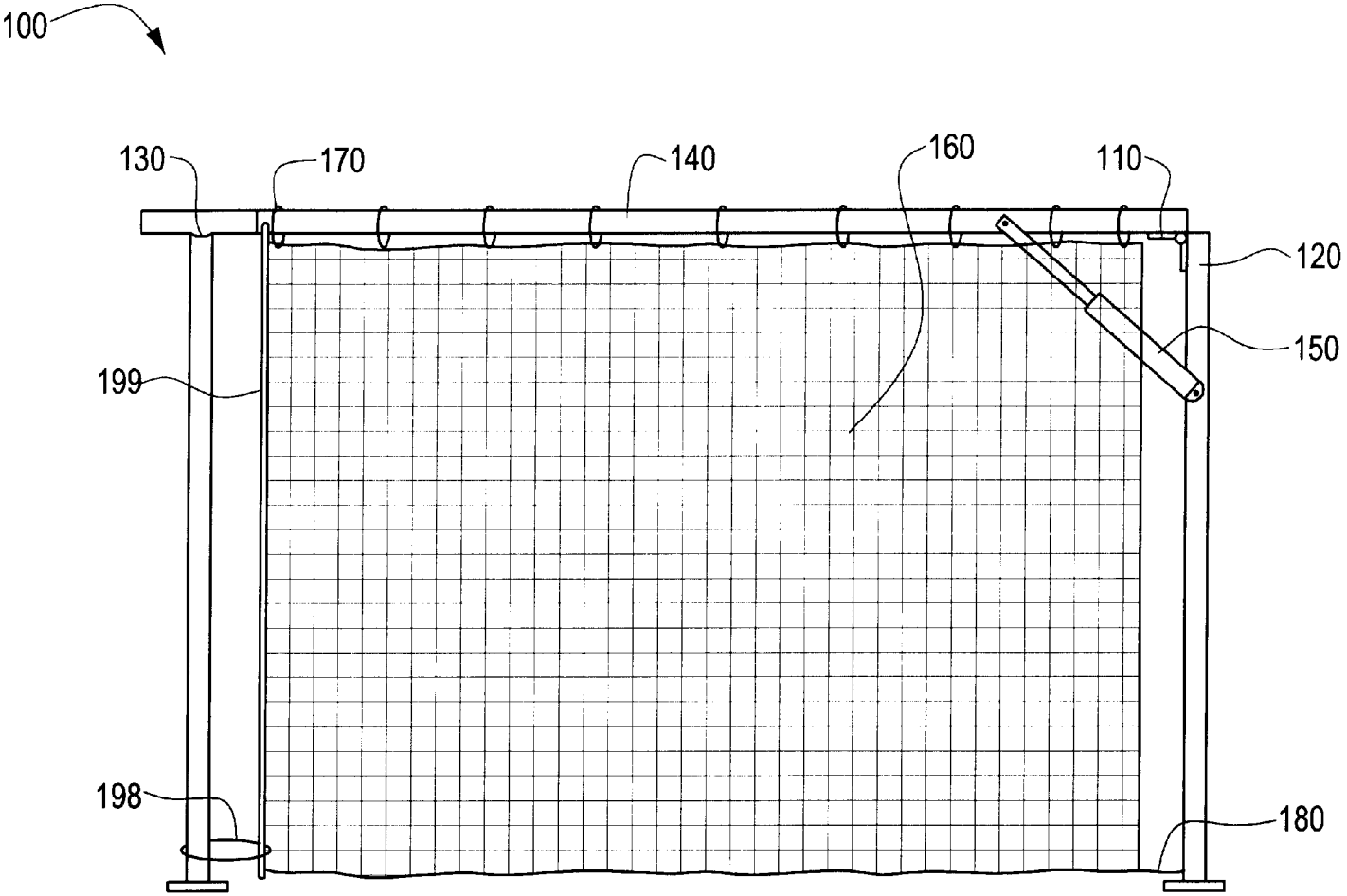
FIG. 7 is a front view of a further embodiment of the safety system of FIG. 4.

Referring now to FIG. 7, the safety system is shown including a guide rod 199. Guide rod 199 is pivotally mounted to upper arm 140, and keeps the safety net 160 extended across the opening when the upper arm 140 is extended. The guide rod 199 is received by receptacle 198 and is maintained therein, thus removing the need to manually connect the corner of the net to the receiving arm 130.

Figure 8:
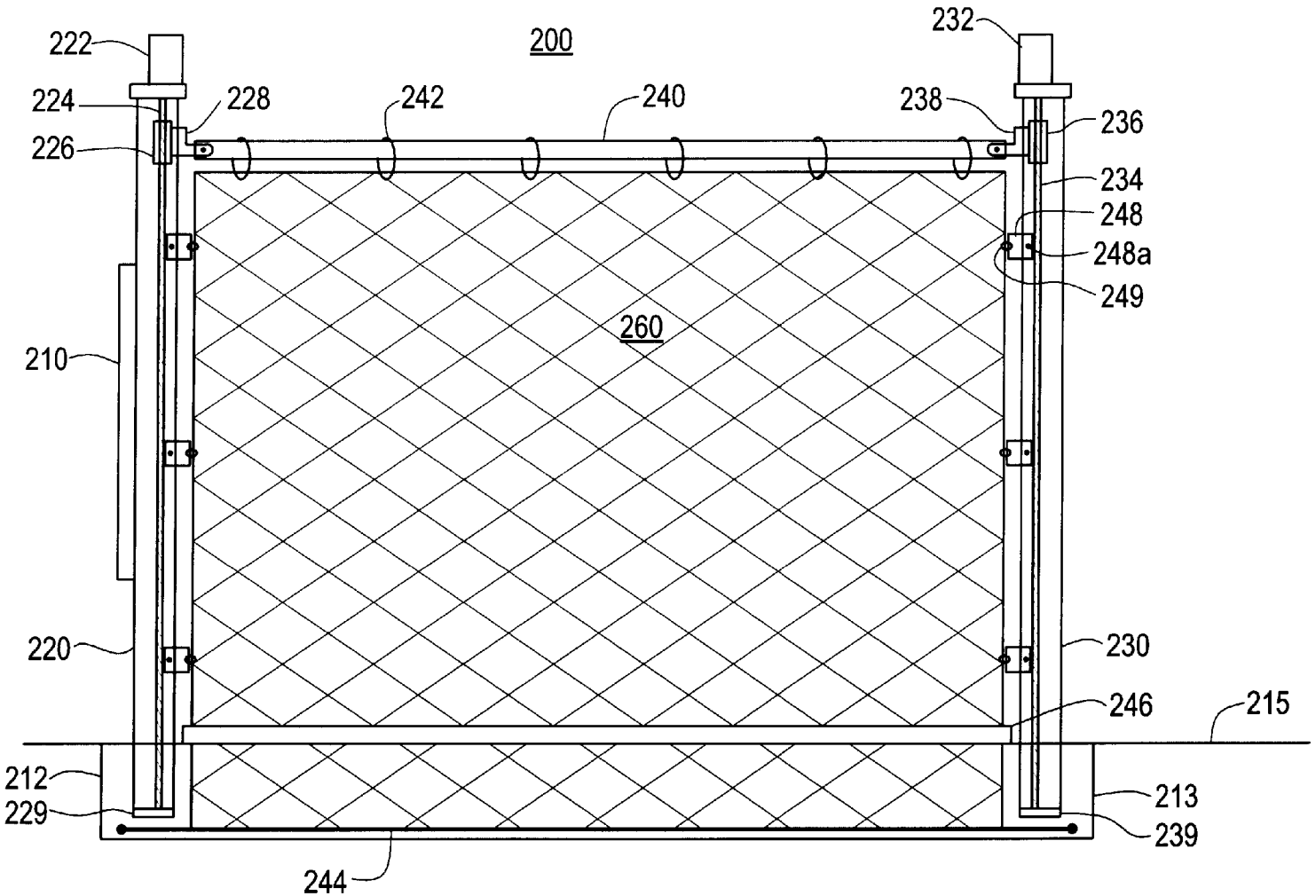
FIG. 8 is a front view of a first embodiment of the motorized safety system in the closed position.

A motorized safety system 200 for protecting an open side of a work area positioned on an elevated structure 215 is illustrated in FIG. 8. First and second motors 222, 232 are mounted on first and second vertical posts 220, 230, respectively, that are secured to the structure 215 by first and second universal baseplates 212, 213 mounted onto the front surface of the structure 215.

The motors 222, 232, such as Oriental Motor model number 51K90A-AFUL, are preferably mounted on the tops of the posts 220, 230 to minimize intrusion into the work area and they are controlled and synchronized by a controller unit 210 that is preferably mounted on the side of one of the vertical posts, e.g., the first vertical post 220. Each motor 222, 232 drives a screw 224, 234, such as Roton model number 60404-72, that is engaged by a drive nut 226, 236. The screw 224, 234 rests on a bottom bearing plate 229, 239 affixed to the bottom of the vertical post 220, 230. As will be described in greater detail below, the drive nut 226, 236 travels along the length of the vertical post 220, 230 as the motor rotates the screw 224, 234.

A top bar link 228, 238 is connected to the drive nut 226, 236 and extends through a vertical slot (not shown) in the post 220, 230 to connect to a respective end of a top bar 240. A safety net 260 is suspended from the top bar 240 by a plurality of rings 242 spaced at essentially equal distances along the length of the top bar 240. The bottom of the safety net 260 is secured to the front of the structure 215 by a bottom assembly, preferably a web cable 250 strung between the universal baseplates 212, 213. Those skilled in the art will recognize that alternative methods of securing the bottom of the safety net 260 to the front of the structure 215 may be employed. Preferably, a kick plate 250 extending along the width of the safety net 260 and rising approximately 3 inches above the horizontal surface of the structure 215 is affixed to the net to protect the net from damage caused by shoes and other surface-level objects. A bumper (not shown) extending across the front of the structure and mounted over the vertical posts 220, 230 protects the safety system 200 from damage caused by forklifts, trucks, etc. The bumper also provides a pocket into which the net is deposited when the top arm is moved to a lower most position below the horizontal surface of the structure 215.

Each side of the safety net 260 is secured by a plurality of slip guides 248, spaced at essentially equal distances up each vertical post 220, 230 when the top arm 240 is deployed in an upper most position. The safety net 260 is attached to each slip guide 248 using a threaded connector or similar connecting mechanism. Each slip guide 248 is held within the vertical slot of a post 220, 230 by a press-fitted dowel or similar retaining mechanism.

Figure 9A:
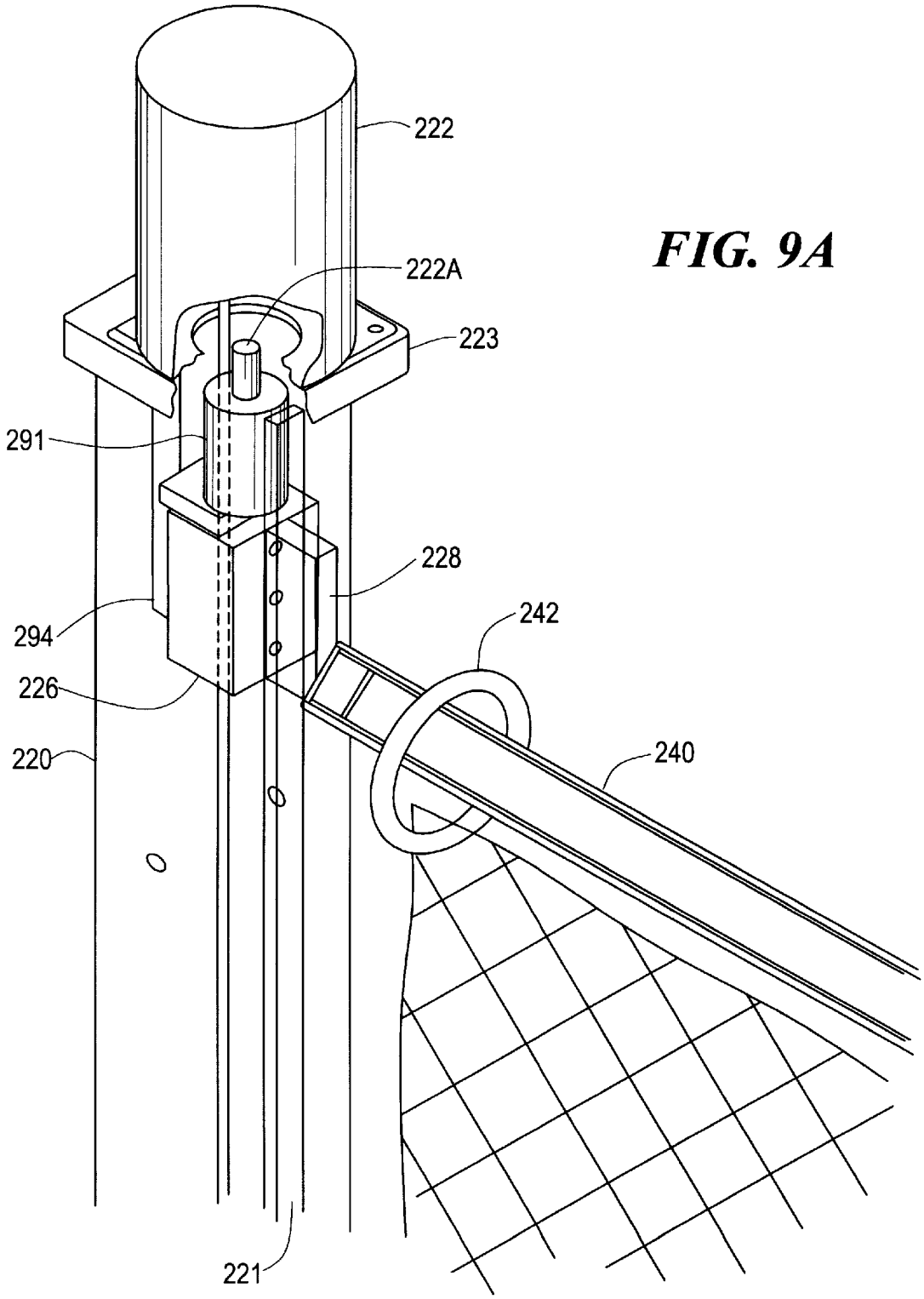
FIG. 9A is a perspective wireframe view of the motor and drive assembly of a vertical post of the motorized safety system of FIG. 8.
Figure 9B:
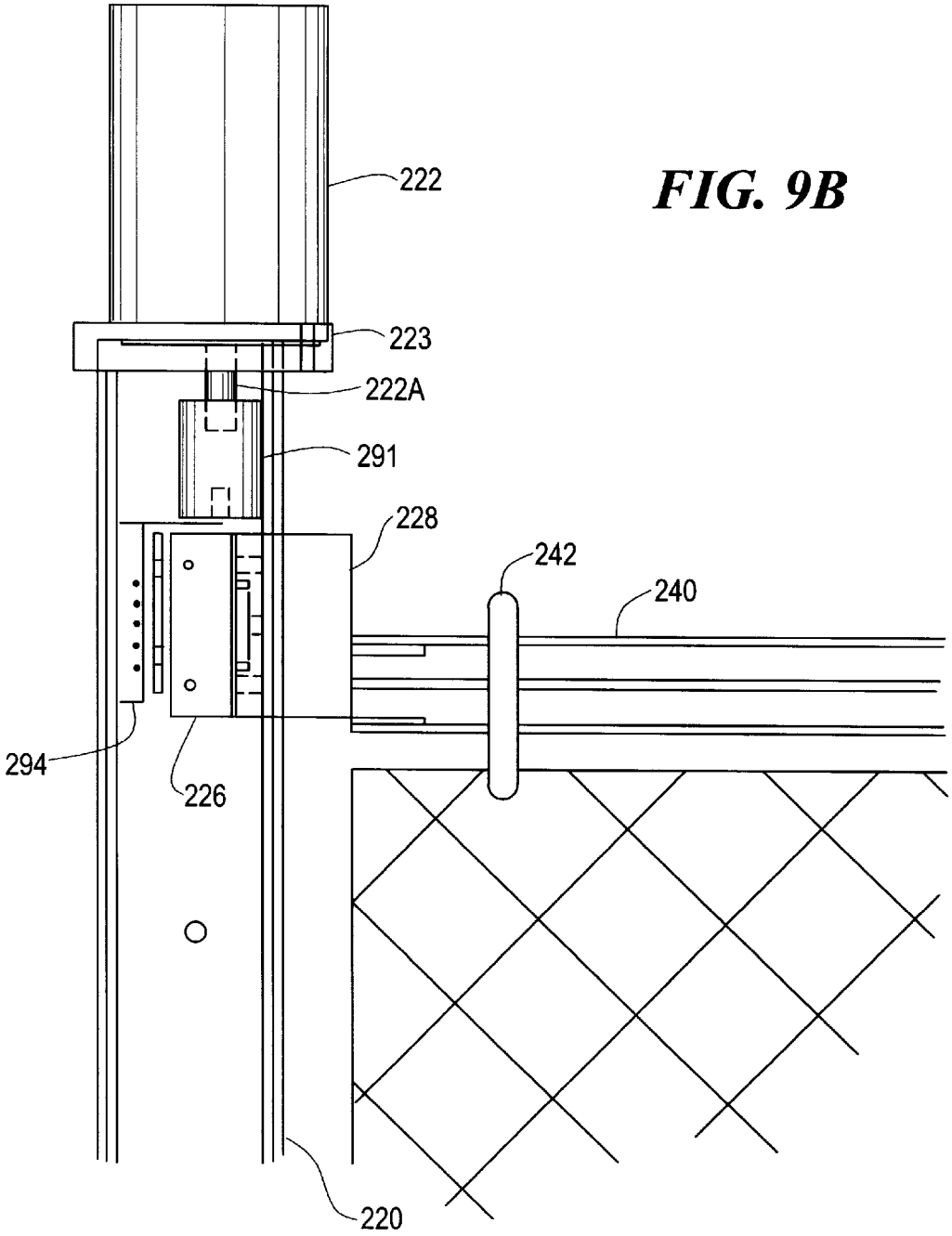
FIG. 9B is a front wireframe view of the motor and drive assembly of a vertical post of the motorized safety system of FIG. 8.
Figure 9C:
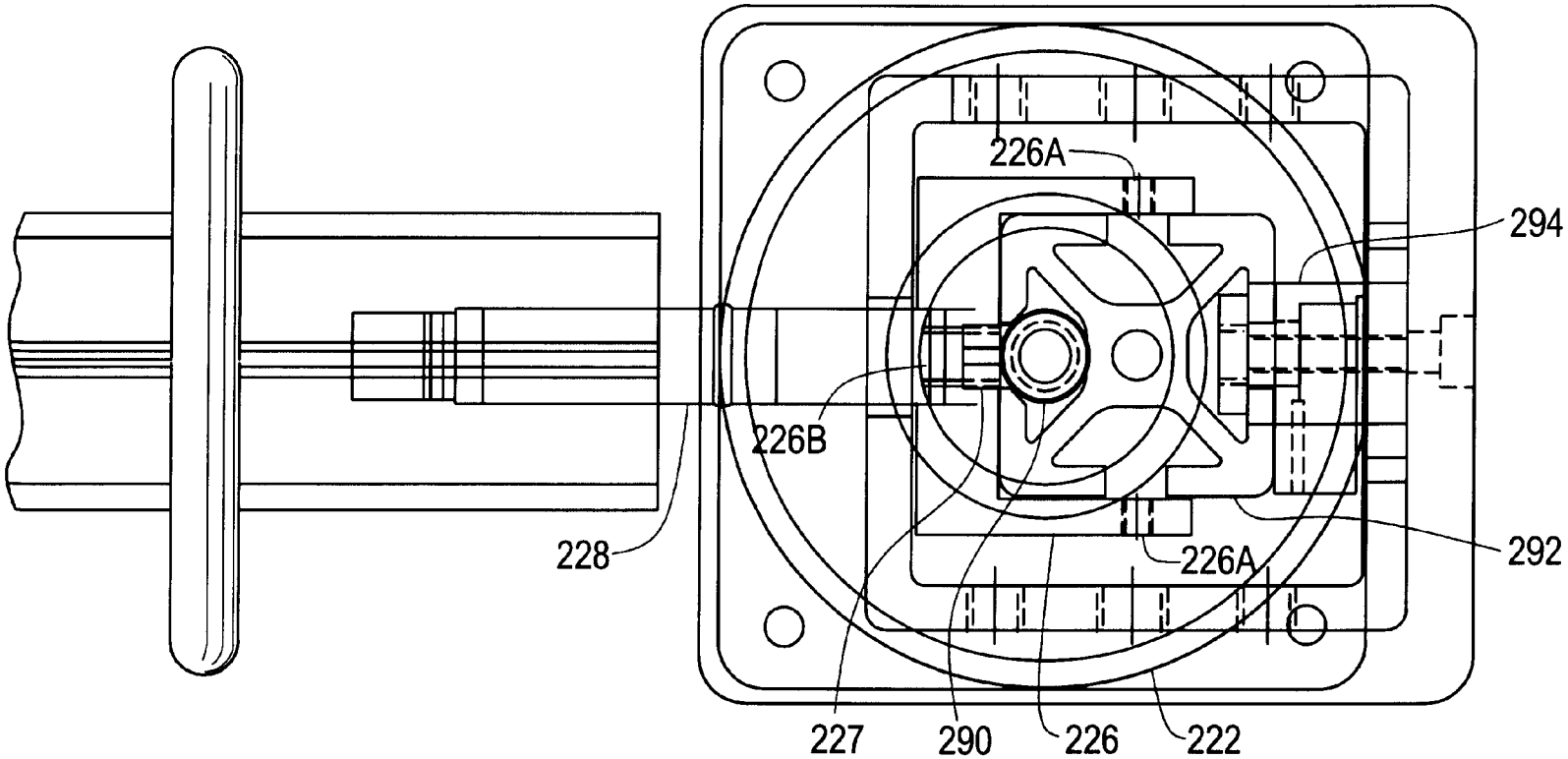
FIG. 9C is a top wireframe view of the motor and drive assembly of a vertical post of the motorized safety system of FIG. 8.
Figure 9D:
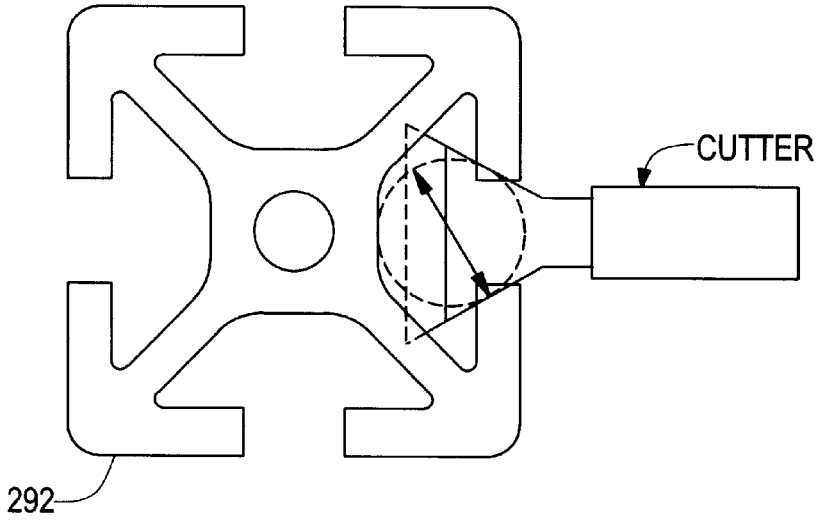
FIG. 9D is an illustration of a modified extrusion of the motorized safety system of FIG. 8.

Perspective, front and top wireframe views of the first vertical post 220 are illustrated in FIGS. 9A–9C, respectively. Those skilled in the art will recognized that the second vertical post 230 is simply a complementary version of the first vertical post 220 and the following discussion therefore applies equally to that post. As illustrated in FIG. 9C, the drive screw 290 is disposed within a modified channel of an extrusion 292, such as 80/20 model number 1515. The outer wall of the extrusion proximate to the drive screw channel has been machined, as illustrated in FIG. 9D, so that the drive screw 290 may be disposed within the channel. The extrusion 290 is mounted on the interior wall of the post 220 opposite to the vertical slot 221 through an upper extrusion mount 294, a center support (not shown) and a lower extrusion mount (not shown).

The drive nut 226 partially wraps around the extrusion 292 so that screw/bushing pairs (not shown) disposed into tapped holes 226A from the inner side extend into side extrusion channels to guide and retain the drive nut 226 as it travels along the length of the modified extrusion 292. The inside surface of the drive nut 226 abutting the drive screw channel of the extrusion 290 includes a pocket into which a nut insert 227 is mounted. The nut insert 227, typically a removed portion of a standard nut, has a threaded pattern complementary to the threads of the drive screw 290 so as to engage the drive screw 290 when the drive nut 226 is placed onto the modified extrusion 292.

The drive nut 226 includes additional tapped openings 226B for receiving screws for attaching the top bar connector 228. The motor 222 is mounted on a motor mount 223 installed on the top of the vertical post 220 and the motor shaft 222A is in mechanical communication with the drive screw 290 via a spider coupling 291.

Figure 10:
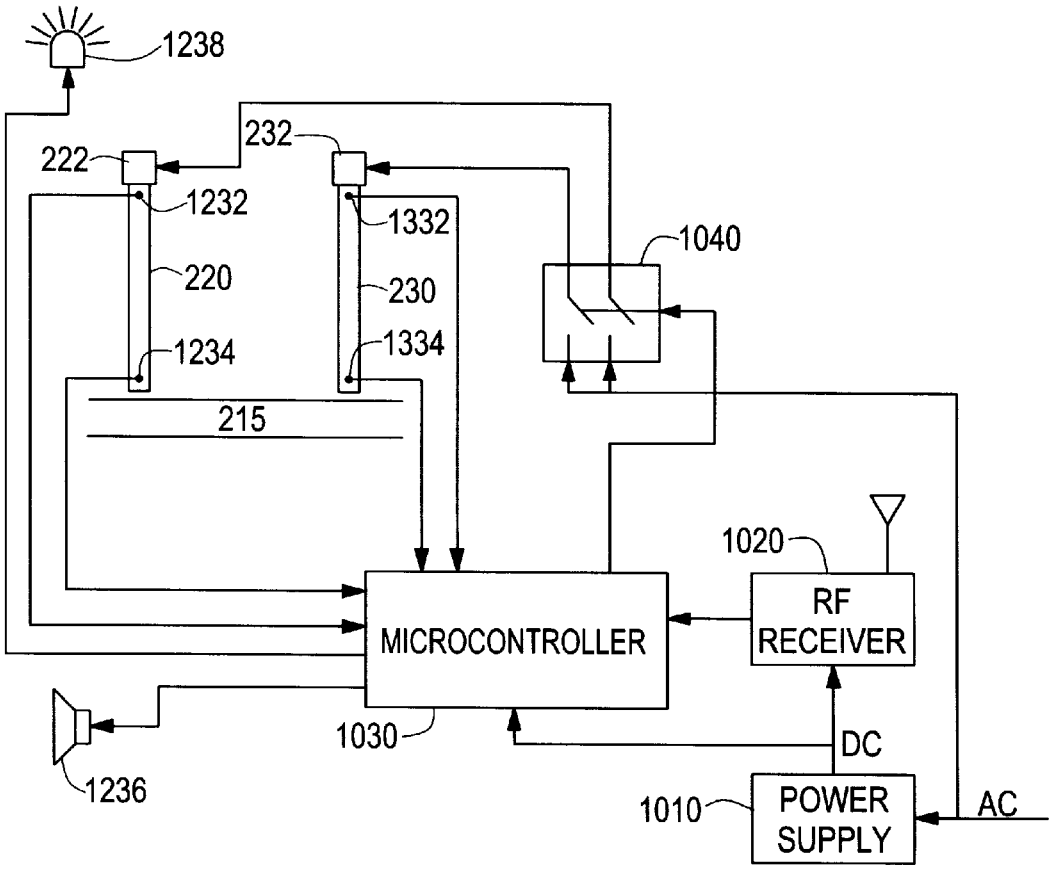
FIG. 10 is a block diagram of the electronic circuitry of the motorized safety system.

A block diagram of the electronic circuitry of the motorized safety system 200 is illustrated in FIG. 10. A DC power supply 1010, a radio-frequency (RF) receiver 1020, a micro-controller 1030 and a relay switch 1040, inter alia, are housed in the controller unit 210 mounted on one of the vertical posts 220, 230. Motor operation is preferably under remote control via a hand-held device (not shown), such as Visitect Inc. model number RF304XT, which may be capable of controlling a plurality of systems at distances up to 250 feet, although local control may also be employed. The user can specify the speed and direction of the travel of the top arm 240 through the hand-held device which modulates this control information onto an RF transmitted signal. The RF receiver 1020, such as Visitect, Inc. model number RF304RM, detects and demodulates the transmitted signal and sends the control information to the micro-controller 1030.

The micro-controller 1030, such as Aromat micro programmable controller model number FPO-C14RS, generates motor drive and directional (CW/CCW) signals for each motor 222, 232. These signals are fed to the solid state relay 1040, such as CRYDOM TD2420Q, to control application of the AC line voltage to the motors 222, 223. The micro-controller may provide an audio warning via a speaker 1236 and/or a visual warning via a flashing light 1238 when the top arm 240 is moving or when the top arm 240 is in a lowered position.

First and second upper limit micro-switches 1232, 1332 and first and second lower limit micro-switches 1234, 1334 are mounted at the tops and bottoms, respectively, of the first and second vertical posts 220, 230. A micro-switch engages when it comes into contact with the drive nut 226 and thus serves to limit the distance of drive nut travel. The micro-controller 1030 monitors the micro-switch signals and turns off the motors when the top arm 240 reaches either the upper or lower limits.

In the event of an electrical fault or power outage, the motorized safety system 200 may be placed in manual override mode wherein the motors are de-mounted and a wrench or similar tool is used to rotate the drive screws.

Those skilled in the art will recognize that the structural components composing the motorized safety system 200 may be fabricated from aluminum or other suitable materials, such as steel, bronze or plastic.

Having described preferred embodiments of the invention it will now become apparent to those of ordinary skill in the art that other embodiments incorporating the concepts of the present invention could also be utilized. Accordingly, it is submitted that the invention should not be limited to the described embodiment but rather should be limited only by the scope and spirit of the appended claims.

What is claimed is:

1. A motorized safety system for protecting an open side of a work area positioned on an upper surface of an elevated structure comprising:

a first post having a top end, a bottom end, and a vertical slot extending from just below said top end to just above said bottom end, said bottom end capable of being secured to said structure;

a first motor having a shaft and mounted on said first post for rotating a first drive screw, said first drive screw in mechanical communication with said first motor shaft and disposed within said first post;

a first drive nut disposed within said first post and engaging said first drive screw, said first drive nut traveling up or down within said first post when said drive screw is rotated by said first motor in an upward or downward direction, respectively;

a second post having a top end, a bottom end, and a vertical slot extending from just below said top end to just above said bottom end, said bottom end capable of being secured to said structure, said second post disposed a predetermined distance away from said first post;

a second motor having a shaft and mounted on said second post for rotating a second drive screw; said second drive screw in mechanical communication with said second motor shaft and disposed within said second post;

a second drive nut disposed within said second post and engaging said second drive screw, said second drive nut traveling up or down within said second post when said second drive screw is rotated by said second motor in an upward or downward direction, respectively;

a top arm disposed between said first post and said second post and having a first end and a second end, said first end in mechanical communication with said first drive nut via a first top arm connector extending through said vertical slot of said first post, said second end in mechanical communication with said second drive nut via a second top arm connector extending through said vertical slot of said second post, said top arm movable between a first position wherein said top arm is positioned between said top end of said first post and said top end of said second post and a second position wherein said top arm is positioned between said bottom end of said first post and said bottom end of said second post and below said upper surface of said structure;

a bottom assembly disposed between said bottom end of said first post and said bottom end of said second post and directly below said second position of said top arm; and a net having a left side, a right side, a bottom side and a top side, said top side of said net secured to said top arm, said bottom side of said net secured to said bottom assembly, said left side of said net movably secured to said first post, and said right side of said net movably secured to said second post, wherein said net and said top arm are disposed below said upper surface of said structure so that movement of workers and machinery into and out of said work area between said first post and said second post is unobstructed.

2. The motorized safety system of claim 1, wherein said first and second drive screws are each disposed within a channel of an extrusion and said corresponding first and second drive nuts are placed onto said extrusion so as to engage threads of said first and second drive screws, respectively.

3. The motorized safety system of claim 1, wherein operation of said first and second motors is controlled via a hand-held device, said hand-held device transmitting a radio frequency carrier modulated with motor control information, said motorized safety system further comprising:

a receiver for detecting said modulated carrier and demodulating said motor control information;

a micro-controller for generating motor control signals in response to said demodulated motor control information; and a solid state relay for generating motor drive signals in response to said motor control signals and applying said motor drive signals to said first and second motors.

4. The motorized safety system of claim 1 further comprising a first pair of upper and lower limit switches mounted at positions proximate to said first post top and bottom, respectively, and a second pair of upper and lower limit switches mounted at positions proximate to said second post top and bottom, respectively, said first and second switch pairs operative to prevent travel of said first and second drive nuts beyond upper and lower post limits.

5. The motorized safety system of claim 1, wherein said first and second sides of said net are movable secured to said first and second posts, respectively, by a plurality of slip guides, each slip guide captured within one of said first and second vertical slots by a dowel and extending from said one vertical slot so as to permit said net to be attached to said slip guide.

6. The motorized safety system of claim 1, wherein said bottom assembly comprises a wire cable.

* * * * *